US006477958B1

(12) United States Patent
Leblond et al.

(10) Patent No.: US 6,477,958 B1
(45) Date of Patent: Nov. 12, 2002

(54) DEVICE TO LINK A CASE AND A PROJECTILE AND PROCESS TO MOUNT A BAND ONTO A PROJECTILE IMPLEMENTING SUCH A LINKING DEVICE

(75) Inventors: Joël Leblond, Bourges (FR); Simon Huguenin, Bourges (FR); Nicolas Eches, Plaimpied Givaudins (FR); Richard Roy, Bourges (FR)

(73) Assignee: GIAT Industries (FR)

( * ) Notice: Subject to any disclaimer, the term of this patent is extended or adjusted under 35 U.S.C. 154(b) by 0 days.

(21) Appl. No.: 09/721,654

(22) Filed: Nov. 27, 2000

(30) Foreign Application Priority Data

Nov. 25, 1999 (FR) ..... 99 14961

(51) Int. Cl.[7] ..... F42B 12/00
(52) U.S. Cl. ..... 102/439; 102/464
(58) Field of Search ..... 102/430, 431, 102/439, 464, 465, 466

(56) References Cited

U.S. PATENT DOCUMENTS 4,815,682 A * 3/1989 Feldmann et al.
4,917,017 A * 4/1990 Beltz
5,129,324 A * 7/1992 Campoli
5,155,295 A * 10/1992 Campoli et al.
5,359,938 A * 11/1994 Campoli et al.
5,563,365 A * 10/1996 Dineen et al.
5,841,062 A * 11/1998 Manole et al.
6,085,660 A * 7/2000 Campoli et al.
6,131,519 A * 10/2000 Thiesen
6,295,934 B1 * 10/2001 Tepera et al.

FOREIGN PATENT DOCUMENTS

EP 0 307 307 A1 9/1988
EP 0 483 787 A2 10/1991
WO WO 95/13516 5/1995

* cited by examiner

*Primary Examiner*—Peter M. Poon
*Assistant Examiner*—Troy Chambers
(74) *Attorney, Agent, or Firm*—Parkhurst & Wendel, L.L.P.

(57) ABSTRACT

A device including a ring for linking a case and a projectile carrying a sealing band having a rear skirt providing low pressure sealing and a front rib lodged in a first groove in the projectile. The ring has a flared rear part connected with the case and a front part connected with the projectile by attachment means. The front part of the ring is lodged between the rear skirt of the band and the projectile and has a lip co-operating with the first groove or with a second groove in the projectile. A process for mounting the sealing band and ring to link the case and projectile includes sliding the sealing band and ring along the projectile in a single operation.

11 Claims, 3 Drawing Sheets

DEVICE TO LINK A CASE AND A PROJECTILE AND PROCESS TO MOUNT A BAND ONTO A PROJECTILE IMPLEMENTING SUCH A LINKING DEVICE

BACKGROUND OF THE INVENTION

The technical scope of the invention is that of devices linking a case and a projectile and more particularly devices allowing a combustible case and a large caliber projectile (caliber of over 45 mm) to be linked together.

DESCRIPTION OF THE RELATED ART

Such a device is known by patent EP-0307307 that comprises a sealing band incorporating a rear skirt linked to the case and providing low pressure sealing (pressure of around a few MPa) and a front rib housed in a groove in the projectile and providing high pressure sealing (pressure of around several hundred MPa), such as is the case in a classical band.

Low-pressure sealing is essential in the first few tenths of milliseconds following the ignition of the propellant charge contained in the combustible case. Indeed, the containment provided by such a case is less than that obtained using a metallic case and the displacement of the projectile occurs at a lower pressure. Sealing that is not sensitive enough to be operational from the point of ignition is likely to allow gases to escape towards the front of the projectile, thereby reducing the efficiency of the propellant charge.

Such a device, however, has certain drawbacks.

The case is generally fastened by riveting its skirt, which is integral with the band.

The fracture of the skirt when passing through the forcing cone of the weapon leads to a reduction in the effective width of the bard. This results in a reduction in the firing capacity of the projectile in worn barrels.

Moreover, the mechanical loads and stresses received by the munition are transmitted to the band whose gas-tightness properties are likely to be deteriorated, thereby leading to dispersion from a ballistic point of view.

SUMMARY OF THE INVENTION

The aim of the invention is to propose a device to link a case and a projectile that does not suffer from such drawbacks.

Thus, the device according to the invention provides for simple reliable attachment whilst increasing the effective length of the band, thereby improving sealing, even for firing from worn barrels.

Thus, the subject of the invention is a device to link a case and a projectile carrying a sealing band having a rear skirt providing low pressure sealing and a front rib housed in a first groove i n the projectile, such device comprising a ring having a flared rear part intended to be made integral with the case and a front part made integral with the projectile by attachment means, wherein the front part of said ring is housed between said rear skirt of said band and said projectile and has a lip co-operating with said first groove or with a second groove in the projectile.

According to a first embodiment, the lip is housed in the first conical-bottomed groove, the tip of the cone being placed on the side of a rear part of the projectile.

The front part of the ring can abut against an inner profile of the band.

The front part of the ring can incorporate an external profile that will co-operate with a matching profile on the band.

According to a second embodiment, the device also prevents the band from being subjected to mechanical stresses transmitted by the projectile or the case.

Such a result is obtained by providing separate first and second grooves.

Advantageously, the front part of the ring will be housed in a second groove and can incorporate at least one inner fluting arranged along a generating line and allowing the gases to pass through the ring up to the band.

According to one variant, at least one fluting can co-operate with an obstacle, such as a pin or a peg, integral with the projectile, such a co-operation enabling the ring and the projectile to be joined together in rotation.

The front part of the ring can incorporate an abutment surface able to co-operate with a matching rear surface of the band, a first play existing between these two surfaces when the band and the ring are in their respective grooves.

The ring can incorporate an inner counter-sink forming an abutment and intended to co-operate with an abutment surface on the projectile, a second play existing between said counter-sink and the projectile, the second play being greater than the first play.

A further aim of the invention is to propose a process to mount, a band onto a projectile, said process being simpler and less expensive that the known process described notably in patent EP-0307307.

According to said patent the band/linking part is fastened to the projectile by injection around the projectile.

Such a process requires the bands to be produced directly on the sabots thereby complicating the production process.

The process according to the invention allows the linking part and band to be produced independently of the sabot. Assembly is only carried out at a later stage. Production is thereby simplified and its cost reduced.

Thus the process according to the invention to mount a band onto a projectile is characterized in that the band and linking ring are made to slide along the projectile in a single operation, the ring pushing the band until both ring and band are clipped into their respective grooves.

Both ring and band can be made of a plastic material and the ring and band will be heated before being put into place.

BRIEF DESCRIPTION OF THE DRAWINGS

The invention will be better understood after reading the following description of the different embodiments, said description being made with reference to the appended drawings, in which.

DETAILED DESCRIPTION OF PREFERRED EMBODIMENTS

Figure 1:
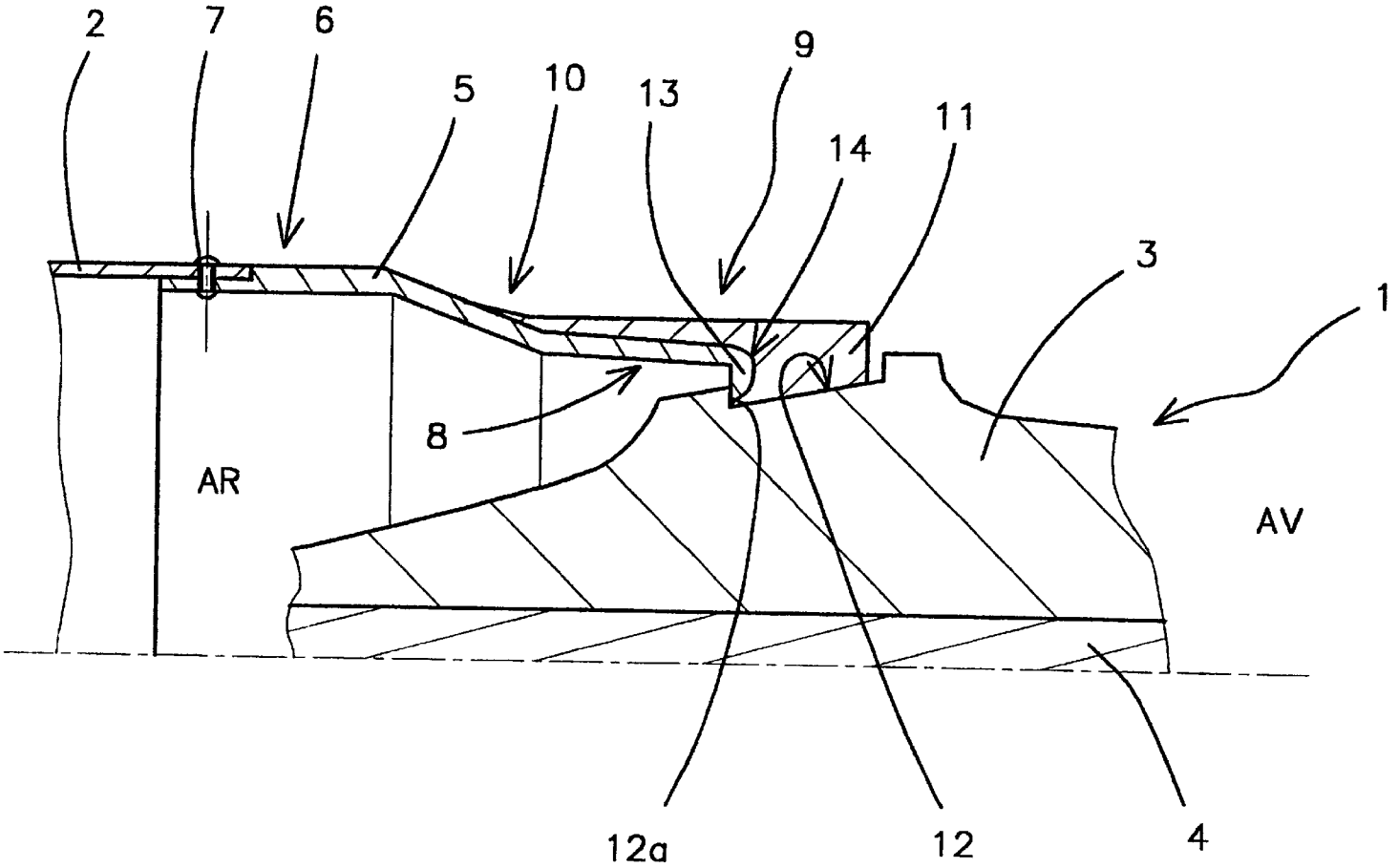
FIG. 1 shows a partial section of a projectile fitted with a linking device according to a first embodiment of the invention.

With reference to FIG. 1, a projectile 1, that here is a fin-stabilized projectile comprising a sabot 3 surrounding a penetrator 4, is made integral with a combustible case 2 by a linking device according to a first embodiment of the invention.

This device comprises a ring 5 having a flared rear part 6 that is made integral with the combustible case 2, for example by rivets 7 evenly spaced angularly. The ring has a front part 8 that is made integral with the projectile 1 by fastening means.

The projectile 1 carries a sealing band 9 that has a rear skirt 10 intended to provide low pressure sealing in the gun barrel. The band 9 incorporates a front rib 11 housed in a first ring-shaped groove 12 arranged in the projectile. The groove 12 has a conical bottom. The tapering of the groove is oriented such that the tip of the cone is arranged on the side of a rear part AR of the projectile. Thus, the diameter at the bottom of the groove 12 increases between the rear AR and the front AV of the projectile.

In accordance with the invention the front part 8 of the ring 5 is housed between the rear skirt 10 of the band 9 and the projectile 1. This front part 8 of the ring has a lip 13 that is housed in the groove 12 of the projectile.

The front part 8 of the ring 5 incorporates an external profile that co-operates with a matching profile of the band. Thus, the external surface of the ring comes into contact with the inner surface of the skirt 10 of the band and the lip 13 has a rounded external profile 14 that is housed in a matching pocket arranged in the band 9.

Both ring and band are made of plastic materials, for example of the polyethylene type for the ring and polyamide for the band.

The band and ring are assembled as follows.

First of all, the ring and the band are heated in a steam oven to a temperature of around 90° C. for around 20 minutes.

Such an operation results in the slight softening of the material constituting the ring and the band thereby facilitating its deformation. The band 9 is thereafter slipped over the projectile 1 from its rear AR. The ring is also slipped over the projectile, and is used to push the band. Both ring and band are radially deformed and are both housed in the groove 12.

The length of the lip 13 is defined such that the ring ensures the axial immobilization of the band in the groove 12. The lip 13 is thus pinched between the front rib 11 of the band and the rear rim 12*a* of the groove 12.

Such an assembly operation can be easily carried out on a projectile during the integration of the munition. It is thus no longer necessary to carry out a duplicate-molding operation around the projectile. Both linking ring and band are made elsewhere by conventional means, for example by injection.

The linking device according to the invention allows a projectile to be defined that is fitted with a band 9 having a relatively long rear skirt 10 (25 to 30 mm for a caliber of 120 mm). This skirt ensures an excellent level of gas-tightness at low pressures.

When the munition is fired, the gas pressure ensures the separation of the ring 5 and the combustible case 2. As proposed in patent EP 307307, the ring will advantageously be equipped with incipient fractures arranged along its generating lines so as to facilitate its fragmentation under the effect of the gas pressure.

A further effect of the gas pressure is to push the band firmly into its groove 12. Said band's conical bottom takes up the play caused by the wear of the band on the inner walls of the gun barrel. Thus, gas-tightness is ensured during the whole of the interior ballistic phase of the projectile and this even when firing from worn barrels.

Such a band also reduces barrel wear since the skirt provides better protection for the inner walls with respect to the hot gases.

Firing reliability is also improved, gas-tightness being ensured during the whole ballistic phase.

Figure 2:
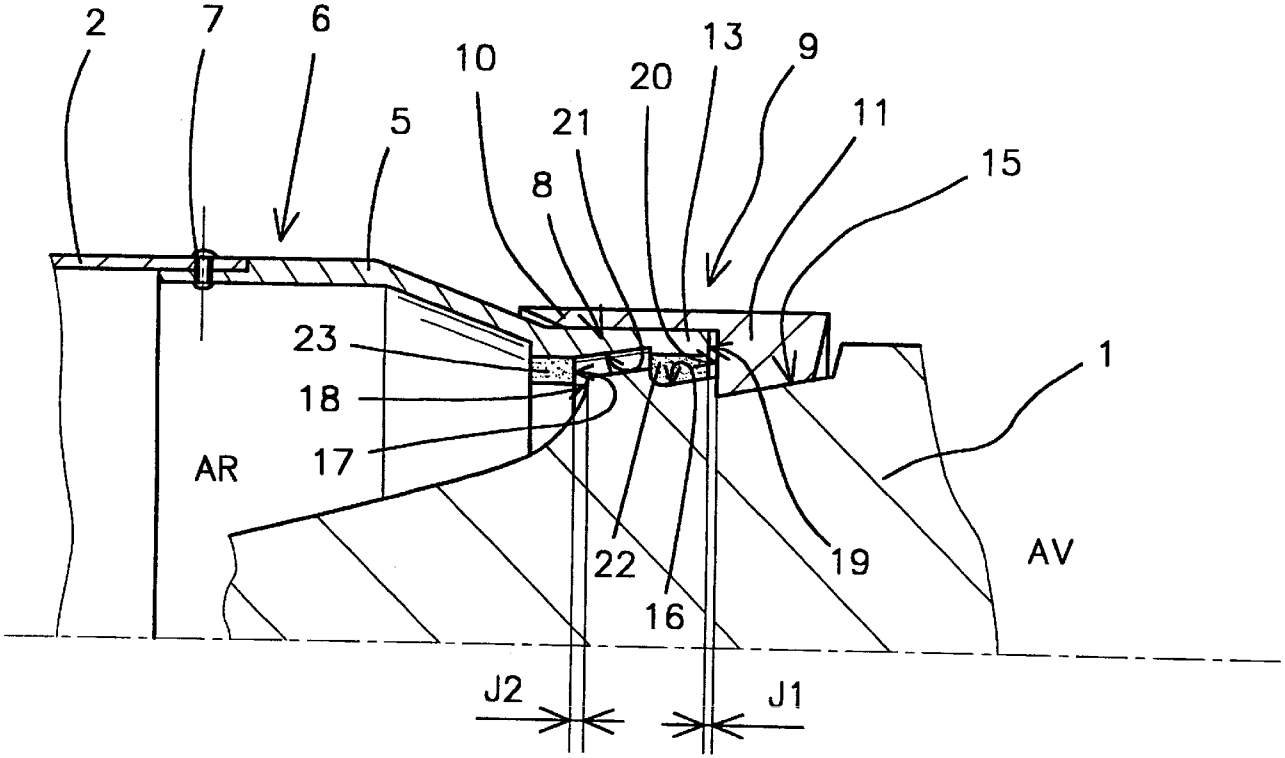
FIG. 2 shows a partial section of a projectile fitted with a linking device according to a second embodiment of the invention.
Figure 3:
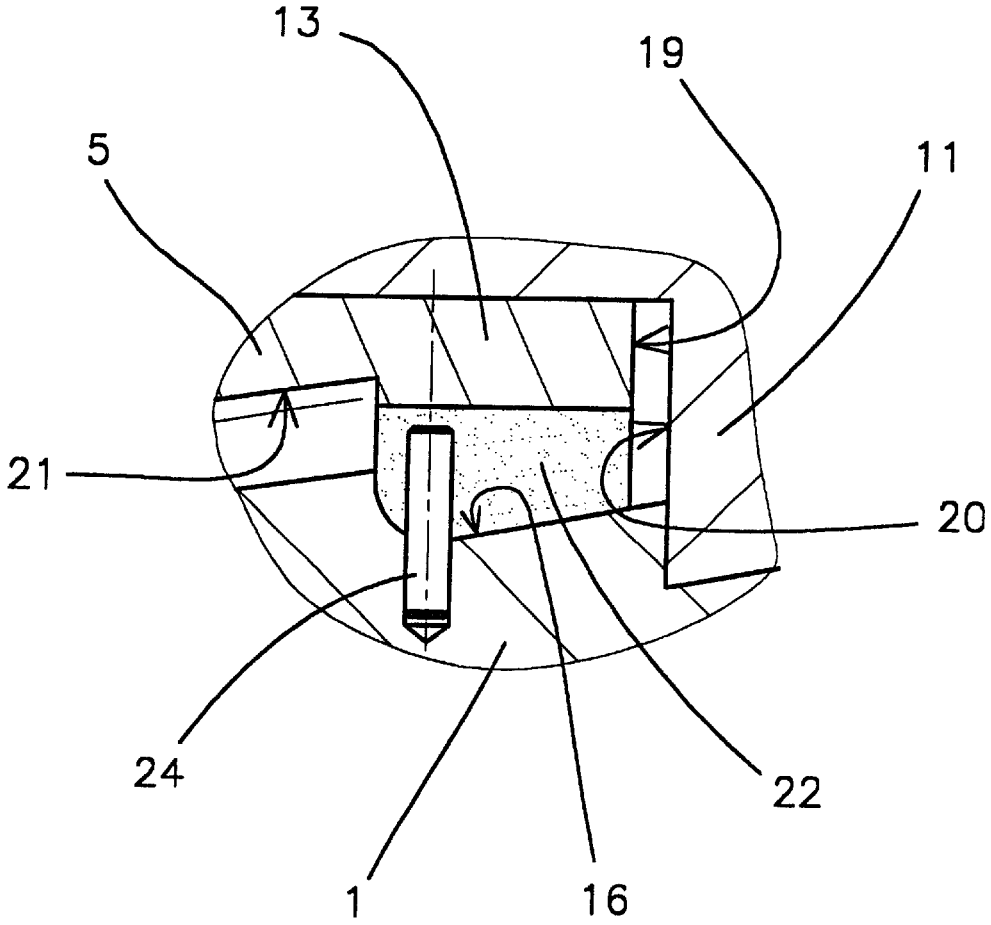
FIG. 3 is a detailed view of a variant of this second embodiment.

FIG. 2 shows a second embodiment of the invention.

This embodiment differs from the previous one mainly in that the ring 5 and the band 11 are each housed in a different groove of the projectile 1. The front rib 11 of the band 9 is housed in a first groove 15 and the lip 13 of the ring 5 is housed in a second ring-shaped groove 16. The two grooves 15 and 16 both have conical bottoms oriented in the same direction and such that the tips of the cones are on the side of a rear part AR of the projectile 1.

When ring and band are in their respective grooves, a first play J1 remains between an abutment surface 19 arranged to the front of the lip 13 and a rear surface 20 of the band 9.

The front part 8 of the ring 5 firstly incorporates the lip 13 that hooks the ring into the second groove 16 and secondly an inner countersink 17 that forms an abutment intended to co-operate with an abutment surface 18 on the projectile 1.

After has ring 5 has been mounted there is a second play J2 between said countersink 17 and the abutment surface 18 on the projectile 1.

Production dimensions and tolerances will be selected such that the second play J2 is greater than the first play J1, this for reasons explained hereafter.

The countersink 17 and lip 13 are connected by a conical profile 21.

Lastly, the front part 8 of the ring incorporates at least one inner fluting arranged along a generating line and allowing the gases to pass through the ring up to the band.

Thus, the flutings 22, evenly spaced angularly (for example four flutings) are made in the lip 13.

Other flutings 23 also evenly spaced angularly (for example four flutings) are made in the countersink 17.

Thus, the propellant gases that develop after the powder load contained in the case 2 has been ignited can move through the flutings 23 of the volume delimited by the conical profile 21 and the flutings 22 until reaching the rear surface 20 of the band.

Such an arrangement allows the gases to push directly on the band 9 and this from ignition of the propellant charge. Gas-tightness is thus improved as it is independent of the fracturing the linking ring 5.

As in the previous embodiment, as the band advances, the conical profile of the first groove 15 makes up for the wear of the band on the inner walls of the gun barrel.

This embodiment also allows a band to be used that has a skirt 10 of great length that is not deteriorated by the action of the linking means.

This band and this ring are assembled as for the previous embodiment.

The ring 5 allows the band 9 to be pushed into its groove 15, the abutment surface 19 of the ring acting directly during assembly on the matching surface 20. As play J1 is less than play J2, it is possible for the band to be pushed to its position in its groove 15 without countersink 17 interfering with the abutment surface 18 of the projectile 1.

The role of the countersink 17 is to take up the load during shocks and handling of the munition. The loads received on the projectile 1 are transmitted to the linking ring 5 via the countersink 17. Thus, the band is neither greatly stressed nor strained and thus retains its full effectiveness during firing.

This embodiment thus enables the sealing function provided by the band 9 to be separated from the projectile/case linking function provided by the linking ring 5.

This separation of functions is provided whilst ensuring the easy assembly of the ring and the band without duplicate-molding being required.

The projectile 1 shown schematically in this Figure is, for example, a calibred projectile, such as a shaped charge.

It may naturally also be a fin-stabilized projectile such as that shown in FIG. 1.

According to a variant embodiment, means will advantageously be provided ensuring the joining in rotation of the ring 5 with the projectile 1. Indeed, assembly by clipping the lips 13 into the first groove 16 does not ensure joining in rotation by friction of a sufficient level to prevent the projectile from pivoting with respect to the ring further, for example, to the vibrations withstood by the munition.

At least one obstacle, such as a pin 24, will be provided that is housed in a hole made radially in the projectile 1.

When the ring 5 is mounted, it will be oriented angularly such that the pin is positioned in the fluting 22.

The pin 24 will be of a diameter substantially equal to the width of the fluting 22. Its height will be less than the depth of the fluting so as not to prevent the gases from passing.

It is naturally possible for as many pins to be provided as there are flutings. Another type of obstacle may also be used, for example one or more pegs.

What is claimed is:

1. A device for linking a case with a projectile carrying a sealing band having a rear skirt providing low pressure sealing and a front rib lodged in a groove in the projectile, said device comprising:

a ring having means for attachment to a projectile, a flared rear part and a front part, wherein said flared rear part is for connecting said ring with a case, said attachment means is for connecting said front part with such a projectile, and said front part is for location between a rear skirt of a sealing band carried by a projectile and the projectile, and said front part of said ring has a lip for co-operating with a groove in said projectile.

2. The linking device according to claim 1, wherein said lip is for location in said groove, said groove being conical bottomed, wherein a point conically projected from said conical bottom is on a side of a rear part of said projectile.

3. The linking device according to claim 2, wherein said front part of said ring is for abutting against an inner profile of the band.

4. The linking device according to claim 3, wherein said front part of said ring incorporates an external profile that is for co-operating with a matching profile on said band.

5. The linking device according to claim 1, wherein said front part of said ring is for location in a second groove and has at least one inner fluting arranged along a generating line and allowing gases to pass through said ring to said band.

6. The linking device according to claim 5, wherein at least one fluting is for co-operating with a pin integral with said projectile, for joining said ring and said projectile.

7. The linking device according to claim 5, wherein said front part of said ring includes an abutment surface for co-operating with a matching rear surface of said band, said abutment surface and said rear surface having a first gap (J1) therebetween when said band and said ring are located in respective grooves.

8. The linking device according to claim 7, wherein said ring has an inner countersink forming a ring abutment surface for cooperating with a projectile abutment surface, said ring abutment surface and said projectile abutment surface having a second gap (J2) therebetween, said second gap being greater than the first gap.

9. The linking device according to claim 6, wherein said front part of said ring has a ring abutment surface for co-operating with a matching rear surface of said band, said ring abutment surface and said band rear surface having a gap (J1) therebetween when said band and said ring are located in respective grooves.

10. A process for mounting a sealing band and ring to link a case and a projectile carrying a sealing band, comprising:

providing a linking ring with means for attachment to a projectile, the ring having a flared rear part and a front part, wherein said flared rear part is for connecting said ring to said case and said attachment means is for connecting a front part with said projectile;

providing a sealing band having a rear skirt providing low pressure sealing and a front rib lodged in a groove in the projectile; and sliding said sealing band and said linking ring along the projectile in a single operation, the ring pushing the band until both ring and band are seated in grooves.

11. The process according to claim 10, wherein said ring and said band comprise a plastic material and said process further comprises heating said sealing band and said linking ring before sliding said sealing band and said linking ring along the projectile.

* * * * *